US006196178B1

(12) United States Patent
Minegishi et al.

(10) Patent No.: US 6,196,178 B1
(45) Date of Patent: Mar. 6, 2001

(54) AIR INTAKE APPARATUS FOR INTERNAL COMBUSTION ENGINE

(75) Inventors: Teruhiko Minegishi; Misturu Yamashita, both of Hitachinaka; Hiroyuki Nemoto, Tokai-mura; Akihiro Munakata, Hitachinaka, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/290,878

(22) Filed: Apr. 14, 1999

(30) Foreign Application Priority Data

Apr. 14, 1998 (JP) ..... 10-103110

(51) Int. Cl.[7] ..... F02D 41/34
(52) U.S. Cl. ..... 123/184.56
(58) Field of Search ..... 123/184.56, 336

(56) References Cited

U.S. PATENT DOCUMENTS 5,555,865 * 9/1996 Kim ..... 123/184.56
5,584,270 * 12/1996 Dohring ..... 123/184.56
5,704,327 * 1/1998 Dohring ..... 123/184.56
5,823,157 * 10/1998 Muramatsu ..... 123/184.56

FOREIGN PATENT DOCUMENTS 60-224924 9/1985 (JP) .
6-81719 3/1994 (JP) .
6-81735 3/1994 (JP) .
8-170536 7/1996 (JP) .

* cited by examiner

*Primary Examiner*—Tony M. Arganbright
*Assistant Examiner*—Jason Benton
(74) *Attorney, Agent, or Firm*—Evenson, McKeown, Edwards & Lenahan, P.L.L.C.

(57) ABSTRACT

A rotating shaft and a drive shaft are used in an air intake apparatus for an internal combustion engine. At one end portion of the rotating shaft and the drive shaft a sphere portion and a projection portion are formed, and another end portion of the rotating shaft and the drive shaft a cup portion and a faucet portion are formed. The sphere portion is inserted to the cup portion and further the projection portion is engaged with the faucet portion, thereby a universal joint is formed. Since a connection structure between the rotating shaft and the drive shaft is constituted with few component elements, a cost reduction in the air intake apparatus for the internal combustion engine can be improved.

6 Claims, 3 Drawing Sheets

AIR INTAKE APPARATUS FOR INTERNAL COMBUSTION ENGINE

BACKGROUND OF THE INVENTION

The present invention relates to an air intake apparatus for an internal combustion engine, and in particular, to an air intake apparatus for an internal combustion engine containing a rotation force transmission structure for an opening and closing valve of an air intake apparatus.

Similar techniques are described in Japanese application patent laid-open publication No. Sho 60-224924, Japanese application patent laid-open publication No. Hei 6-81719, Japanese application patent laid-open publication No. Hei 6-81735, and Japanese application patent laid-open publication No. Hei 8-170536, etc.

In a construction shown in FIG. 2 of Japanese application patent laid-open publication No. Sho 60-224924, by rotating a substantially cylindrically shaped surge tank, a position of an opening portion of an air intake conduit is varied, and when a length of the air intake conduit is varied, an output torque of an internal combustion engine can be heightened by utilizing an air intake inertia effect.

In a construction shown in FIG. 33 of Japanese application patent laid-open publication No. Hei 6-81719 or in a construction shown in FIG. 3 of Japanese application patent laid-open publication No. Hei 6-81735, an opening and closing valve is provided at a midway point of an air intake conduit. When an internal combustion engine rotates at a low speed rotation, by closing the opening and closing valve, a length of the air intake conduit is made long, and an output torque during the low speed rotation of the internal combustion engine is heightened.

In a construction shown in Japanese application patent laid-open publication No. Hei 8-170536, two air intake conduits having different lengths are shown. At an air intake passage of an intermediate portion of the shorter air intake conduit, a cylindrical shape shielding mechanism is provided. In response to a rotation number of an internal combustion engine, the shielding mechanism is opened or closed, and by employing only the other longer air intake conduit or by employing both air intake conduits, an increase in a flow passage cross-sectional area is selected, as a result an output torque of the internal combustion engine is heightened.

In each of the above stated prior arts, the aim is to heighten the output torque utilizing the inertia effect of the intake air in the internal combustion engine. The length of the air intake conduit or the flow passage cross-sectional area is varied. To vary the length of the air intake conduit or to vary the flow passage cross-section area, a butterfly shaped valve or a cylindrical shaped opening and closing valve is used.

The butterfly shape valve comprises a flat plate shaped valve main body and a rotating shaft, and the valve main body and the rotating shaft are manufactured separately or independently. This valve main body and this rotating shaft are combined with screw members etc. The rotating shaft has a long and slender rod shape. To this rotating shaft plural butterfly shaped valves are installed. To prevent an obstruction of a rotation sliding operation due to a bending deformation of the rotating shaft, not only is a bearing member provided to both ends of the rotating shaft, but also, a bearing member is provided between the butterfly shape valve and another butterfly shaped valve.

When installing the above stated assembly with the valve main body and the bearing members at a midway point of the air intake conduit an, where the air intake conduit is formed by two-divisional construction or two separated parts, there is a fear of lowering the dimensional accuracy of the air intake apparatus during assembly.

On the other hand, in the cylindrical shaped opening and closing valve in the air intake apparatus for the internal combustion engine, an opening portion which penetrates in a radial direction is provided on the cylindrical shaped opening and closing valve. A valve portion is constituted by the opening portion and another portion. By rotating this opening portion, the intake air, which passes through the opening portion, is discontinued.

With the above stated mechanism, a whole peripheral portion of the cylinder of the internal combustion engine becomes a rotating shaft. A bending deformation of the rotating shaft in the cylindrical shaped opening and closing valve is smaller than that of the rotating shaft of the butterfly shaped valve. Since a shaft portion and the valve portion are manufactured integrally, the manufacturing is easier.

Further, by employing an assembling method in which a hole portion for inserting the cylindrical shaped opening and closing valve is manufactured integrally in an axial direction with a part of the air intake conduit of the air intake apparatus for the internal combustion engine, and the cylindrical shaped opening and closing valve is inserted in to this hole portion, it is unnecessary to divide two parts, such as the air intake conduit in the case of the butterfly shape valve. A accordingly a lowering in a dimensional accuracy of the air intake apparatus for the internal combustion engine in a radial direction, which is accompanied by the assembling work, can be avoided.

In a construction of the air intake apparatus for the internal combustion engine shown in Japanese application patent laid-open publication No. Hei 8-170536, one end of a cylindrical shaped opening and closing valve is contacted to a small hole portion which is provided at a bottom of a hole portion, and also, using a spring member, the cylindrical shaped opening and closing valve is added with an axial direction force to come off from this small hole portion of the cylindrical shape opening and closing valve.

However, in the above stated prior arts, there is no consideration about a relationship between a direction of the rotating shaft of the connection member and a direction of the rotating shaft of the cylindrical shaped opening and closing valve. As a result, since a divergence exists, there is a possibility the rotation may become rough.

The inventors of the present invention have filed a prior patent application about an air intake apparatus for an internal combustion engine in which the problems not solved in the above stated prior arts can be solved (at the present patent filing time, the above stated prior patent application is not laid-opened and does not form the prior art against the present patent application). Namely, in the prior patent application, the connection member for the cylindrical shaped opening and closing valve and the rotating mechanism is contacted to the cylindrical shaped opening and closing valve through a ball like member.

Even if the inclination (the divergence) exists between the direction of the rotating shaft of the connection member for connecting the rotating mechanism and the direction of the rotating shaft of the cylindrical shape opening and closing valve, since the ball like member works as one kind of a ball joint mechanism, the rotation can be transmitted smoothly.

SUMMARY OF THE INVENTION

An object of the present invention is to solve, the problems which have not been solved in the prior arts. Namely when an inclination exists between an axial direction of a rotating shaft for rotating a cylindrical shaped opening and closing valve and an axial direction of a drive shaft, a rotating motion can be transmitted smoothly. Another object of the present invention is to provide an air intake apparatus for an internal combustion engine with a simple construction, and an easy manufacturing. A low cost air intake apparatus for the internal combustion engine can be provided.

Further, another object of the present invention is to provide an air intake apparatus for an internal combustion engine wherein a durability in the air intake apparatus can be heightened by carrying out a position regulation against a thrust direction of a drive shaft.

A sphere portion which is provided at a tip end portion of a shaft portion of one of the rotating shaft or the drive shaft or input shaft (in this application, it is called the drive shaft) is inserted into a cup member which is provided at a tip end portion of another shaft of one of the rotating shaft or the drive shaft, or a projection portion of one of the rotating shaft and the drive shaft is engaged with a faucet portion which is provided at the tip end portion of the other shaft of the rotating shaft or the drive shaft. Thus, a universal joint is constituted. According to these constructions, a welding working and a shaving-off working become unnecessary.

Further, a position regulation of a thrust direction of the drive shaft is attained. The drive shaft and a ball bearing member are inserted under pressure and fixed, and after the ball bearing member has been inserted in to a resin housing, in accordance with a stopping operation due to a spring force by a stopper ring and a bite-in of the stopper ring to the resin housing, the ball bearing member is fixed to the resin housing. According to this construction, by the stopper ring having the spring operation the ball bearing member can be fixed to the resin housing.

Thus, the present invention can provide a following air intake apparatus for the internal combustion engine.

The present invention can provide an air intake apparatus for an internal combustion engine comprising an opening and closing valve for shielding the air intake supplied to an internal combustion engine, a rotating shaft installed to the opening and closing valve as one body, a drive shaft for rotating the rotating shaft, a connection portion for connecting the rotating shaft and the drive shaft and for transmitting motion from the drive shaft to the rotating shaft.

The air intake apparatus for the internal combustion engine wherein on an end portion of one of the rotating shaft or the drive shaft, a sphere portion and a projection portion are formed. On another end portion of one of the rotating shaft or the drive shaft, a cup portion and a cup raise portion are formed, and the sphere portion is inserted into the cup portion. Further the projection portion is engaged with the cup raise portion, thereby a universal joint is formed.

Preferably, an inner portion of the above stated cup raise portion is formed with a dent shape, and further, an outer portion of the above stated projection portion is formed with a raise portion.

Preferably, the above stated drive shaft is provided in the resin housing, and to the above stated drive shaft a ball bearing member is fixed. To the resin housing a part of the ball bearing member is stopped, and further, the ball bearing member is fixed to the above stated resin housing by a stopper ring having a spring operation.

The present invention provides an air intake apparatus for an internal combustion engine in which the above stated drive shaft is provided in the resin housing, a shaft portion of the above stated opening and closing valve and the above stated drive shaft are connected with a universal joint construction, above stated drive shaft a ball bearing member is fixed, and to the above stated resin housing a part of the ball bearing member is stopped. Further, the above stated ball bearing member is fixed to the above stated resin housing by a stopper ring having a spring operation.

DESCRIPTION OF THE INVENTION

Hereinafter, an air intake apparatus for an internal combustion engine of one embodiment (a first embodiment) according to the present invention will be explained referring to figures.

In an air intake apparatus for an internal combustion engine of one embodiment (the first embodiment) according to the present invention, an air intake apparatus for a spark ignition system internal combustion engine which uses the fuel such as gasoline is exemplified, however, the present invention can be applied to the air intake apparatuses for other internal combustion engines such a self ignition system internal combustion engine, or others.

Figure 1:
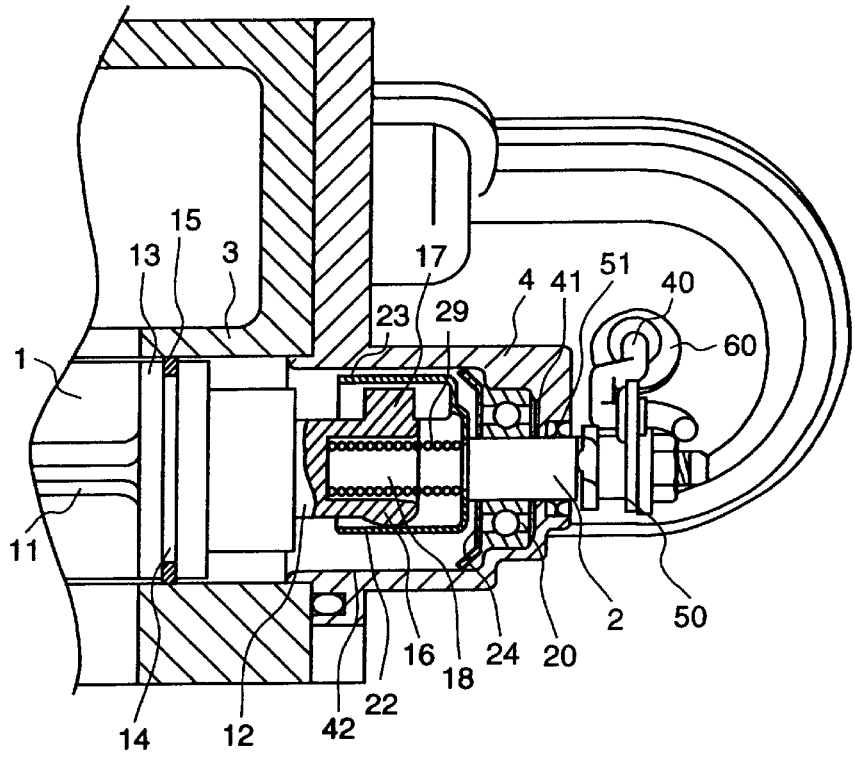
FIG. 1 is a cross-sectional view showing an air intake apparatus for an internal combustion engine of one embodiment (a first embodiment) according to the present invention.
Figure 2:
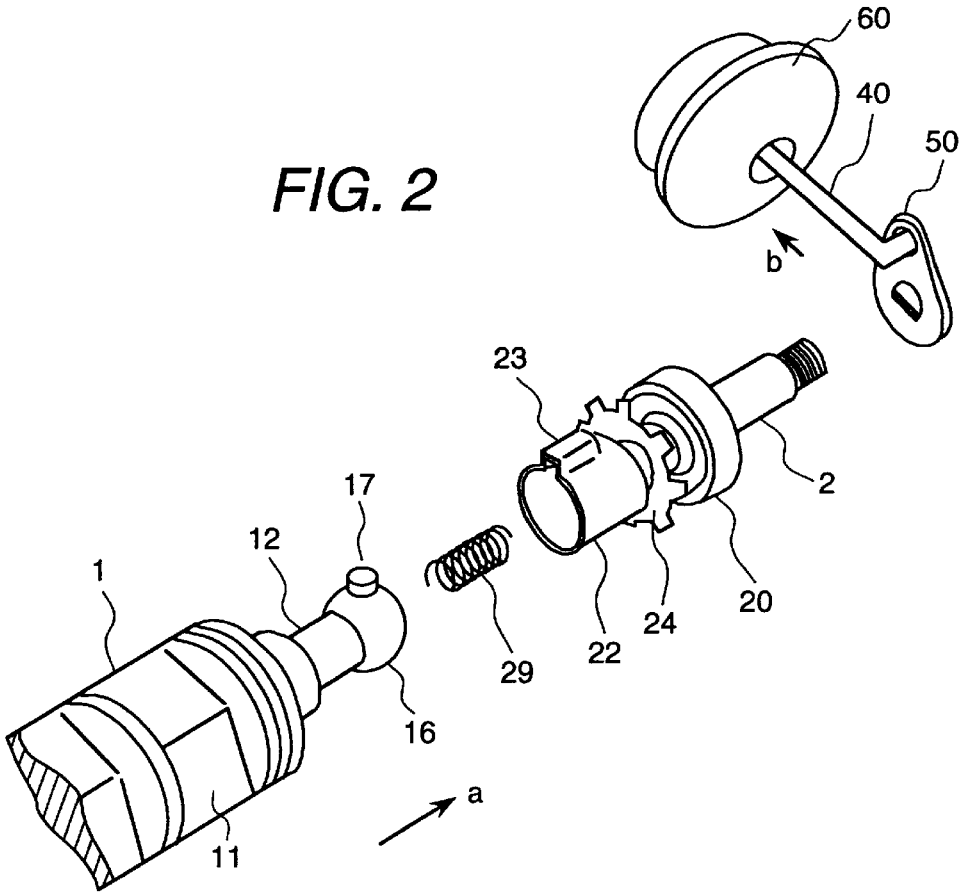
FIG. 2 is a perspective view showing a construction summary of an air intake apparatus for an internal combustion engine of one embodiment (the first embodiment) according to the present invention.

A summary of a construction of an air intake apparatus for an internal combustion engine of one embodiment (the first embodiment) according to the present invention will be explained referring to FIG. 1 and FIG. 2. FIG. 1 shows a detailed cross-sectional view showing an air intake apparatus for an internal combustion engine of one embodiment (the first embodiment) which guides the air intake for supplying the internal combustion engine (not shown in figure), and FIG. 2 shows a perspective view of a component construction of the air intake apparatus for the internal combustion engine shown in FIG. 1.

The air intake apparatus for the internal combustion engine comprises mainly an air intake conduit and the air intake conduit for guiding the air intake which is inhaled to the internal combustion engine. An injector is installed to the air intake conduit, and the injector supplies the fuel to a combustion chamber of a respective cylinder of the internal combustion engine. A fuel conduit is installed to the injector, and the fuel is supplied to the combustion chamber of the internal combustion engine.

The above stated air intake conduit of the internal combustion engine comprises a collector comprised of one chamber, branches having same number air intake passages to a number of cylinders of the internal combustion engine, a flange for combining with a throttle valve opening and closing valve which adjusts an amount of the air intake, and another flange for combining an internal combustion engine block. Those above stated elements are manufactured integrally.

A construction of an opening and closing valve 1 of the air intake apparatus for the internal combustion engine will be explained referring to FIG. 1 and FIG. 2.

An essential construction of the opening and closing valve 1 in the air intake apparatus for the internal combustion engine have a valve body portion 11, a rotating shaft 12, and a valve holder 3. The valve body portion 11 has a flat plate shape, and the rotating shaft 12 has a round rod shape. Since each of the valve body portion 11 and the rotating shaft 12 has a simple shape, the valve body portion 11 and the rotating shaft 12 can be manufactured integrally and easily.

For example, each of the materials for the valve body portion 11 and the rotating shaft 12 of the air intake apparatus can employ a synthetic resin and can be made according to an integral transformation process or can be manufactured according to an integral casting process or a forging process using a light alloy metal such as an aluminum alloy metal. Further, of course the valve body portion 11 and the rotating shaft 12 can be formed respectively using a separate material or an individual material.

To the rotating shaft 12, a pair of sealing portions 13 are formed in a peripheral direction with respect to the above stated air intake branches, and a sealing ring 15 is fitted into a groove 14 which is formed at an intermediate portion of the pair of sealing portions 13. This sealing ring 15 is fitted rotatively against a rotation direction of the valve body portion 11 of the opening and closing valve 1. A material for the sealing ring 15 is established by taking into consideration sliding performance. The sealing ring 15 works a role of a sealing operation of the intake air together with an inner face of the valve holder 3.

A sphere shape portion 16 is formed at a tip end portion of the rotating shaft 12, and further, a projection portion 17 is formed integrally. The projection portion 17 has a shape to which a part of the sphere shape portion 16 is projected. A hole portion 18 is formed at a center portion of a shaft portion to which the sphere shape portion 16 is provided and to this hole portion, 18 a spring member 29, as stated later, is inserted.

Figure 3:
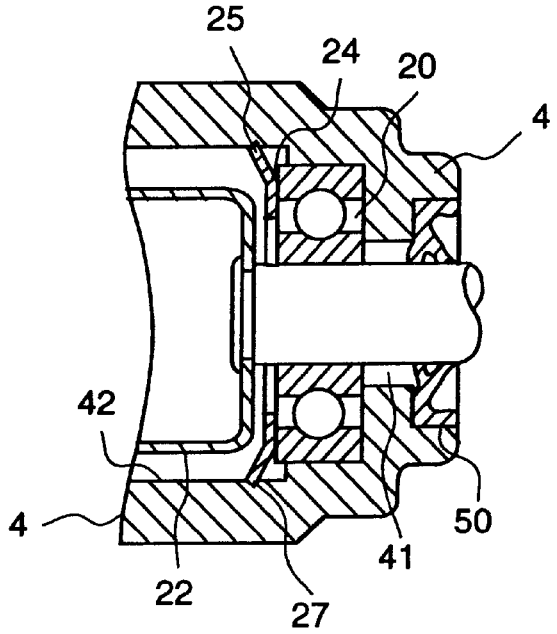
FIG. 3 is a detailed view showing a part of the air intake apparatus for the internal combustion engine of one embodiment according to the present invention shown in FIG. 1.
Figure 4:
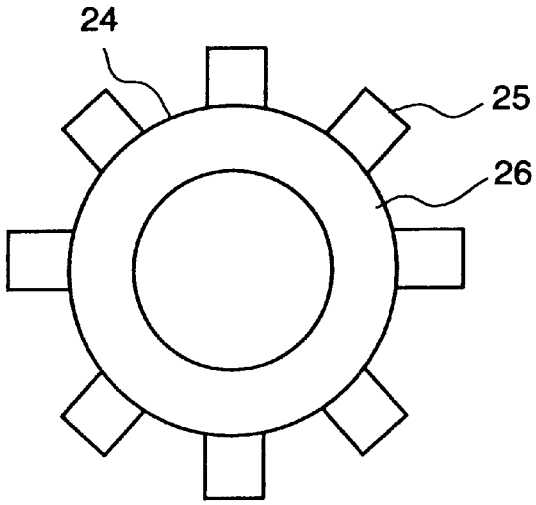
FIG. 4 is a detailed view showing one component (a stopper ring) of the air intake apparatus for the internal combustion engine of one embodiment according to the present invention shown in FIG. 3.

The valve holder 3 is formed with a resin housing 4 as one body. A drive shaft 2 is provided in a drive shaft use hole portion 41 which is arranged with the resin housing As stated in the above, according to the first embodiment of the present invention, a ball bearing member 20 is inserted under pressure and fixed to the drive shaft 2, and to the resin housing 4, the ball bearing member 20 is inserted and fixed. A stopper ring 24 is provided at a left end side of the ball bearing member 20. This stopper ring 24, as shown in FIG. 4, is comprised of a thin single plate 26 which is manufactured by a punching-out process, and at a periphery portion of the stopper ring 24, plural projection portions 25 having a gear shape are formed. This projection portion 25 has a spring operation. This stopper ring 24 is arranged as shown in FIG. 3.

Inserting this stopper ring 24 into a hole portion 42 which is formed at an interior portion of the resin housing 4, generates the reaction force, and by this reaction force, the projection member 25 is bitten into an inner face of the resin housing 4 and is stopped. Then, the ball bearing member 20 is pressed against the resin housing 4, and according to this operation, a thrust direction position regulation of the drive shaft 2 is carried out. Additionally the drive shaft 2 can be rotated. A reference numeral 27 shown in FIG. 3 indicates a bite-in portion.

As stated in the above, at one end of the drive shaft 2 the ball bearing member 20 is inserted under pressure and fixed, and another end of the drive shaft 2 is penetrated to a hole portion 26 which is provided on the stopper ring 24. Likewise, a cup member 22 is fixed to the drive shaft 2. The cup member 22 has a cup shape which is formed by elastic processing using a pressing-out process, and an inner diameter of the cup member 22 is substantially equal to an outer diameter of the above stated sphere shape portion 16. At a part of the cup member 22, a faucet portion, for example as shown in FIG. 2, a cup raise portion 23 is formed. An inner side of the cup raise portion 23 has a dent portion as shown in FIG. 2.

The opening and closing valve 1 moves to the right, as shown in an arrow mark a of FIG. 2, and the sphere portion 16 which is provided at the tip end portion of the above stated rotating shaft 12 is fitted into the cup member 22. Further, the projection portion 17 is fitted into an inner face dent portion of the cup raise portion 23. A spring member 29 is arranged between the inner face of the cup member 22 and an inner portion hole 18 of the rotating shaft 12, and the spring member 29 prevents a jolt in a longitudinal direction to the opening and closing valve 1. With the construction constituted in the above, a universal joint is formed.

As stated above, in the air intake apparatus for the internal combustion engine, even if the axial direction of the rotating shaft 12 and the axial direction of the drive shaft 2, are non-parallel according to the universal joint operation a rotation torque of the drive shaft 2 can be transmitted to the rotating shaft 12 without the obstacle. In accordance with the engagement between the cup raise portion 23 and the projection portion 17, since the rotation torque transmission can be carried out, and since the fixing between the drive shaft 2 and the cup member 22 can be carried out according to the fitting-into, the construction can be made simply, and the number of components is low. As a result the cost reduction of the air intake apparatus for the internal combustion engine can be attained.

Of course, the fixing manner used between the drive shaft 2 and the cup member 22 can be screw members, and further, the fixing can be an adhesion process, a pressure-in process, a welding method or other process.

A rotation input from an actuator 60 is transmitted to the drive shaft 2. The actuator 60 is comprised of an actuator 60 output rod 40, a cover member, a spring member, a diaphragm member, one diaphragm member receiver, and another diaphragm member receiver. The actuator output rod 40 is made to move an input lever 50.

When the negative pressure is supplied to a negative pressure chamber of the actuator 60, the diaphragm member is moved, as a result the actuator 60 output rod 40 is moved to an arrow mark b direction and the input lever 15 is moved. Then the drive shaft 2 is rotated. A reference numeral 51 indicates an air-tight sealing using lip sealing.

The input lever 50 has a function in which the rotation of the drive shaft 2 is stopped at a predetermined angle.

Figure 5:
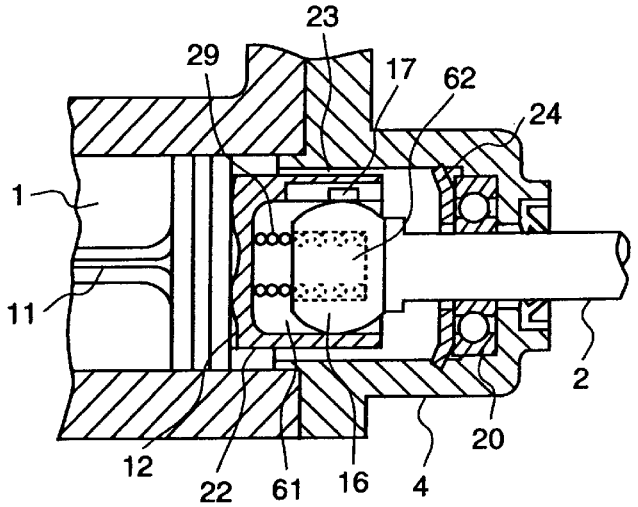
FIG. 5 is a cross-sectional view showing an air intake apparatus for an internal combustion engine of another embodiment (a second embodiment) according to the present invention.

FIG. 5 shows another universal joint for constituting a connection portion between the rotating shaft 12 and the drive shaft 2 of a second embodiment according to the present invention.

In the air intake apparatus for the internal combustion engine of the above stated first embodiment according to the present invention, the sphere shape portion 16 and the projection portion 17 are formed to the rotating shaft 12, and the cup member 22 and the cup raise portion 23 are formed to the drive shaft 2. However, in the air intake apparatus for the internal combustion engine of this embodiment (the second embodiment) according to the present invention, the first embodiment is reversed. The sphere shape portion 16 and the projection portion 17 can be formed to the drive shaft 2, and the cup member 22 and the cup raise portion 23 are formed to the rotating shaft 12.

In the air intake apparatus for the internal combustion engine of this second embodiment, the sphere shape portion 16 and the projection portion 17 are formed with the resin material, and the sphere shape portion 16 and the projection portion 17 can be fixed to the drive shaft 2. The above stated sphere shape portion 16 is received in a hole portion 61 which is provided in an interior portion of the rotating shaft 12. Further, a spring member 29 is received in a hole portion 62 which is provided in an interior portion of the sphere shape portion 16, and then, the pressure-in operation is generated between the rotating shaft 12 and the drive shaft 2.

With the above stated air intake apparatus construction in the second embodiment, similar to the air intake apparatus of the first embodiment, the universal joint operation can be obtained. Further, the air intake apparatus construction having the same functions in the second embodiment are indicated using the same reference numerals as in the first embodiment.

Figure 6:
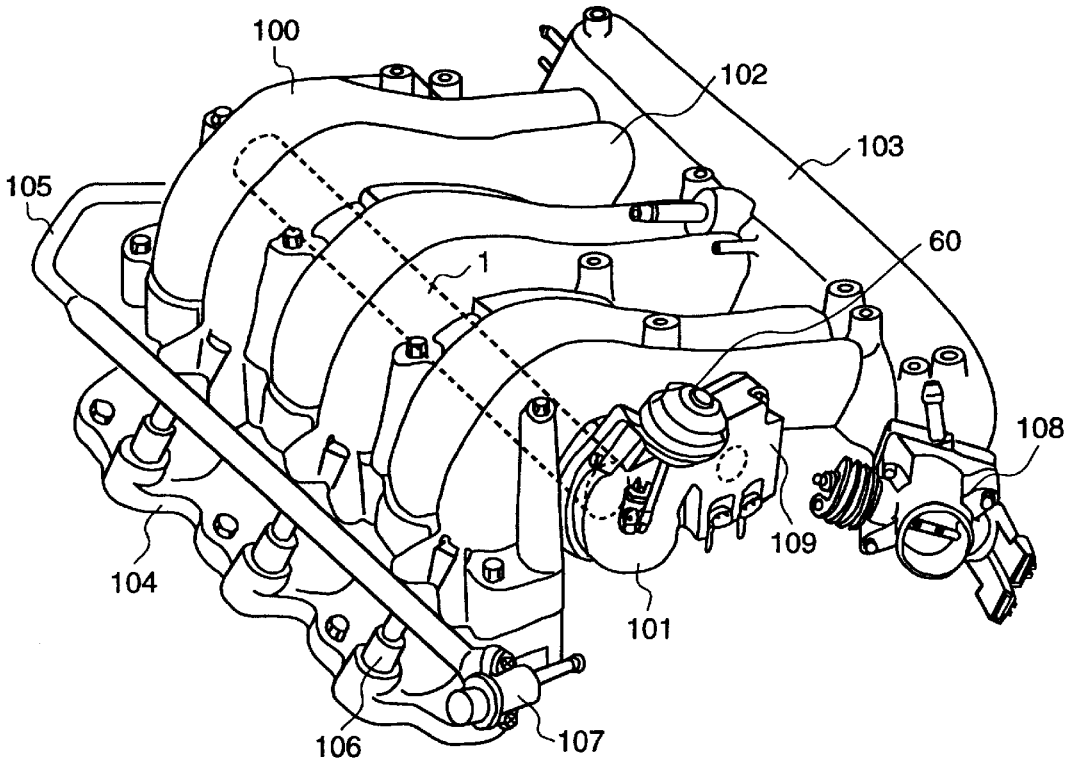
FIG. 6 is a perspective view showing an air intake apparatus construction for an internal combustion engine according to the present invention.

FIG. 6 is a perspective view showing an air intake apparatus construction for an internal combustion engine according to the present invention. In FIG. 6, an air intake apparatus construction 100 for an internal combustion engine comprises mainly a negative pressure module 101, four independent branching conduits 102, a collector 103, an air intake manifold 104, a fuel pipe 105, an injector 106, a fuel pressure regulator 107, a throttle valve chamber 108, and an actuator solenoid 109. To the negative pressure module 101, the opening and closing shaft 1, the actuator 60, and the actuator solenoid 109 are installed.

According to the present invention, in the connection construction between the rotating shaft and the drive shaft in the air intake apparatus for the internal combustion engine, since the combination construction between the sphere shape portion and the cup portion, and the combination construction of the engaging construction between the projection portion and the cup raise portion are adopted, the entire assembly can be made according to the simple construction and the easy manufacture construction. As a result, the rotation transmission can be carried out smoothly with the low cost construction.

Further, according to the present invention, since the ball bearing member in the air intake apparatus for the internal combustion engine is pressed by the stopper ring having the spring operation, the thrust direction regulation of the drive shaft can be attained by the simple construction, and the cost reduction of the air intake apparatus for the internal combustion engine can be obtained by the simple construction.

What is claimed is:

1. An air intake apparatus for an internal combustion engine comprising a rotating shaft which is installed to an opening and closing valve for shielding the air intake supplied to an internal combustion engine as one body, a drive shaft for rotating said rotating shaft, and a connection portion for connecting said rotating shaft and said drive shaft and for transmitting a motion from said drive shaft to said rotating shaft, the air intake apparatus for the internal combustion engine, wherein on an end portion of one of said rotating shaft and said drive shaft, a sphere portion and a projection portion are provided;

on an end portion of one of said rotating shaft and said drive shaft, a cup portion and a cup raise portion are provided; and said sphere portion is inserted into said cup portion and further said projection portion is engaged with said cup raise portion, thereby a universal joint is formed.

2. An air intake apparatus for an internal combustion engine according to claim 1, wherein an inner portion of said cup raise portion is formed with a dent shape, and an outer portion of said projection portion is formed with a raise portion.

3. An air intake apparatus for an internal combustion engine according to claim 1, wherein said drive shaft is arranged in a resin housing, and to said drive shaft a ball bearing member is fixed; and to said resin housing a part of said ball bearing member is stopped, and said ball bearing member is fixed to said resin housing by a stopper ring having a spring operation.

4. An air intake apparatus for an internal combustion engine, wherein a drive shaft is arranged in a resin housing;

a shaft of an opening and closing valve and said drive shaft are connected with a universal joint construction;

to said drive shaft a ball bearing member is fixed; and to said resin housing a part of said ball bearing member is stopped, and said ball bearing member is fixed to said resin housing by a stopper ring having a spring operation.

5. An air intake apparatus for an internal combustion engine comprising a rotating shaft which is installed to an opening and closing valve for shielding the air intake supplied to an internal combustion engine as one body, a drive shaft for rotating said rotating shaft, and a connection portion for connecting said rotating shaft and said drive shaft and for transmitting a motion from said drive shaft to said rotating shaft, the air intake apparatus for the internal combustion engine, wherein on an end portion of said rotating shaft, a sphere portion and a projection portion are provided;

on an end portion of said drive shaft, a cup portion and a cup raise portion are provided; and said sphere portion is inserted into said cup portion and further said projection portion is engaged with said cup raise portion, thereby a universal joint is formed.

6. An air intake apparatus for an internal combustion engine comprising a rotating shaft which is installed to an opening and closing valve for shielding the air intake supplied to an internal combustion engine as one body, a drive shaft for rotating said rotating shaft, and a connection portion for connecting said rotating shaft and said drive shaft and for transmitting a move from said drive shaft to said rotating shaft, the air intake apparatus for the internal combustion engine, wherein on an end portion of said drive shaft, a sphere portion and a projection portion are provided;

on an end portion of said rotating shaft, a cup portion and a cup raise portion are provided; and said sphere portion is inserted into said cup portion and further said projection portion is engaged with said cup raise portion, thereby a universal joint is formed.

* * * * *